US006139135A

United States Patent [19]

Becker et al.

[11] Patent Number: 6,139,135

[45] **Date of Patent: *Oct. 31, 2000**

[54] INKJET PRINTING WITH REPLACEABLE SET OF INK-RELATED COMPONENTS (PRINTHEAD/SERVICE MODULE/INK SUPPLY) FOR EACH COLOR OF INK

[75] Inventors: Rick Becker, Sant Cugat del Vallès, Spain; Brian Canfield, Encinitas, Calif.; Jesus Garcia, Sant Cugat del Vallès, Spain; Doug Watson, Escondido, Calif.; Don Boutin, Poway, Calif.; Eric Joseph Johnson, Encinitas, Calif.; Robert Giles, Sant Cugat del Vallès, Spain; Mark E. Young, Escondido, Calif.; Elizabeth Zapata, Barcelona; Felix Ruiz, Sant Cugat del Vallès, both of Spain

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/810,485

[22] Filed: Mar. 3, 1997

[51] Int. Cl.[7] ..... M41J 2/175

[52] U.S. Cl. ..... 347/85

[58] Field of Search ..... 347/7, 33, 85, 347/86, 87, 22, 32

[56] References Cited

U.S. PATENT DOCUMENTS

| | | | |
|---|---|---|---|
| 3,930,258 | 12/1975 | Dick et al. | 346/75 |
| 4,223,323 | 9/1980 | Bader et al. | 347/85 |
| 4,412,232 | 10/1983 | Weber et al. | 347/86 |
| 4,475,116 | 10/1984 | Sicking et al. | 347/86 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,833,491 | 5/1989 | Rezanka | 347/43 |
| 4,929,963 | 5/1990 | Balazar | 347/89 |
| 4,959,667 | 9/1990 | Kaplinsky | 347/87 |
| 4,967,207 | 10/1990 | Ruder | 347/7 |
| 4,968,998 | 11/1990 | Allen | 347/7 |
| 4,970,528 | 11/1990 | Beaufort et al. | 346/25 |
| 5,121,132 | 6/1992 | Pan et al. | 347/87 |
| 5,126,767 | 6/1992 | Asai | 347/89 |
| 5,136,305 | 8/1992 | Ims | 347/7 |
| 5,280,300 | 1/1994 | Fong et al. | 347/87 |
| 5,329,294 | 7/1994 | Ontawar et al. | 397/87 |
| 5,359,353 | 10/1994 | Hunt et al. | 347/86 |
| 5,367,328 | 11/1994 | Erickson | 347/7 |
| 5,369,429 | 11/1994 | Erickson | 347/7 |
| 5,638,099 | 6/1997 | Nguyen et al. | 347/22 |
| 5,644,347 | 7/1997 | Schwiebert et al. | 347/33 |
| 5,650,811 | 7/1997 | Seccombe et al. | 347/85 |

FOREIGN PATENT DOCUMENTS

| | | | |
|---|---|---|---|
| 0 237 787 A3 | 2/1987 | European Pat. Off. . | |
| 0 519 664 A2 | 6/1992 | European Pat. Off. . | |
| 93 00 133 U | 1/1993 | Germany . | |
| 61-12347A | 1/1986 | Japan | B41J 3/04 |

OTHER PUBLICATIONS

Patent Abstracts of Japan, published by the European Patent Office, Publication No.:60248355, Publication Date: Sep. 12, 1985.

*Primary Examiner*—N. Le
*Assistant Examiner*—Anh T. N. Vo

[57] ABSTRACT

An inkjet printing system having a replaceable set of ink-related components which are installed together and replaced together as a single ink delivery system for each different color of ink. The set includes an ink printhead cartridge with an inlet port, an ink supply module, and a printhead service module, each of which is manually mountable by a user onto an inkjet printer. The ink supply module contains enough ink to completely replenish an entire printhead reservoir several times before the expected useful life of the printhead cartridge has expired, at which time a user can replace the entire set of ink-related components for a particular color. Similarly, the printhead service module is designed for reliable performance for the expected useful life of the printhead cartridge. This system enables the entire ink delivery system to be replaced for different printing needs, such as replacing indoor dye-based inks with outdoor pigment based inks.

21 Claims, 16 Drawing Sheets

FIG. 6
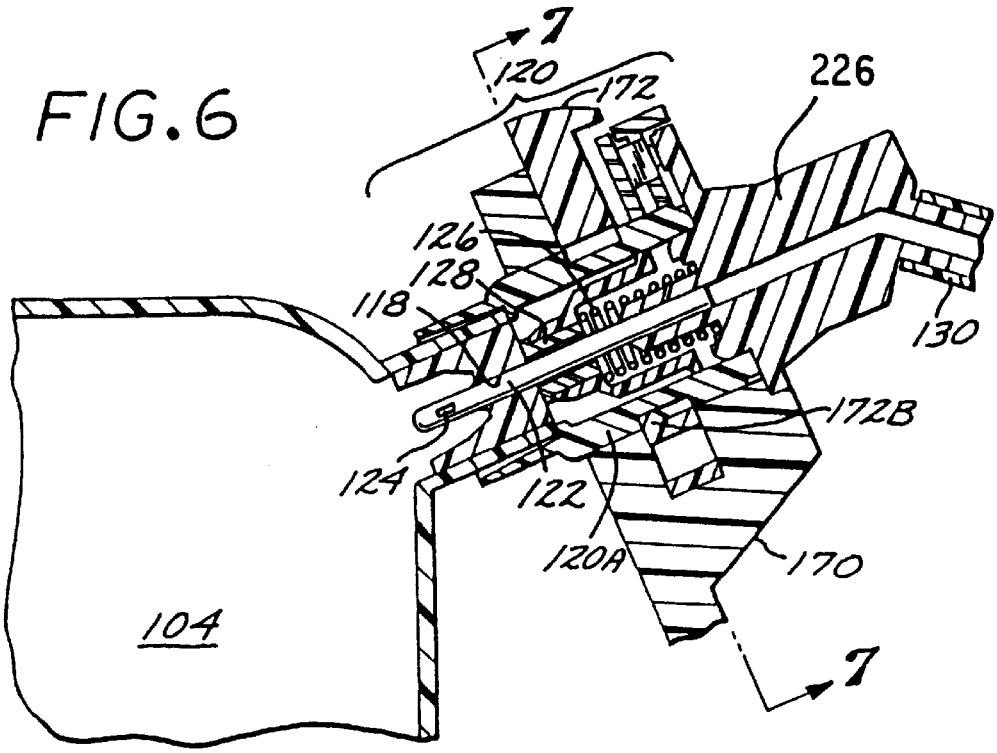
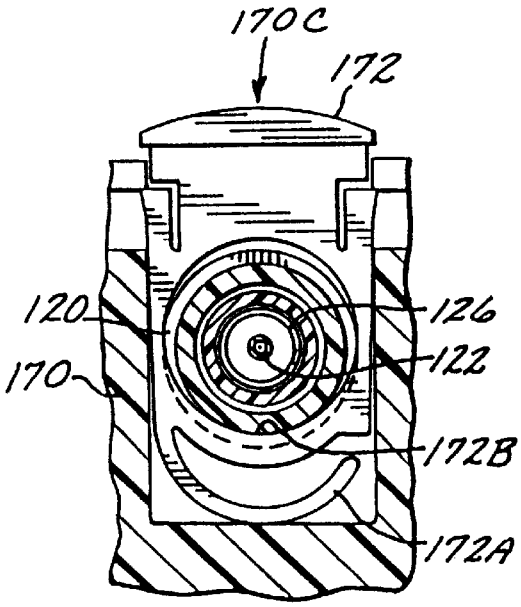
FIG. 7
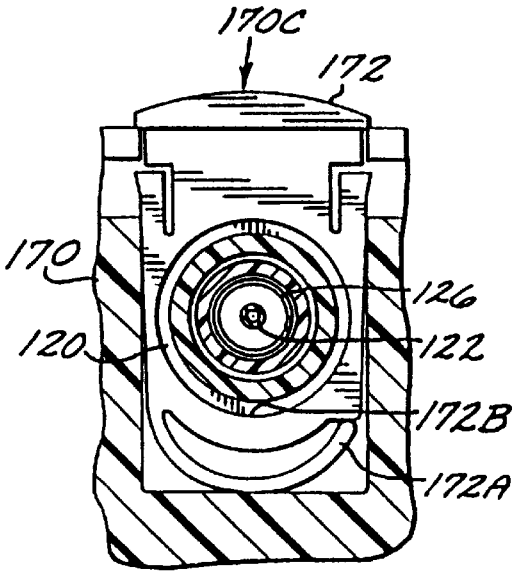
FIG. 8

INKJET PRINTING WITH REPLACEABLE SET OF INK-RELATED COMPONENTS (PRINTHEAD/SERVICE MODULE/INK SUPPLY) FOR EACH COLOR OF INK

CROSS-REFERENCE TO RELATED APPLICATIONS

A previously filed co-pending commonly assigned application related this application is Ser. No. 08/454,975 filed May 31, 1995 by Joseph E. Scheffelin et al. (the "'975 application") entitled CONTINUOUS REFILL OF SPRING BAG RESERVOIR IN AN INK-JET SWATH PRINTER/PLOTTER, which is incorporated herein by reference.

Other more recent co-pending commonly assigned related applications are application Ser. No. 08/726,587, filed Oct. 7, 1996, entitled INKJET CARTRIDGE FILL PORT ADAPTOR, by Max S. Gunther, et al. now U.S. Pat. No. 5,874,976; application Ser. No. 08/805,859, filed Mar. 3, 1997, entitled REPLACEABLE INK SUPPLY MODULE (BAG/BOX/TUBE/VALVE) FOR REPLENISHMENT OF ON-CARRIAGE INKJET PRINTHEAD, by E. Zapata et al.; application Ser. No. 08/805,860, filed Mar. 3, 1997, entitled SPACE-EFFICIENT ENCLOSURE SHAPE FOR NESTING TOGETHER A PLURALITY OF REPLACEABLE INK SUPPLY BAGS, by E. Coiner, et al.; application Ser. No. 08/910,840, filed Mar. 3, 1997, entitled PRINTING SYSTEM WITH SINGLE ON/OFF CONTROL VALVE FOR PERIODIC INK REPLENISHMENT OF INKJET PRINTHEAD, by M. Gunther et al. now U.S. Pat. No. 5,929,883; application Ser. No. 08/805,861, filed Mar. 3, 1997, entitled PRINTER APPARATUS FOR PERIODIC AUTOMATED CONNECTION OF INK SUPPLY VALVES WITH MULTIPLE INKJET PRINTHEADS, by Olazabal et al.; and application Ser. No. 08/806,749, filed Mar. 3, 1997, entitled VARIABLE PRESSURE CONTROL FOR INK REPLENISHMENT, by M. Young et al. now U.S. Pat. No. 5,992,985.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced applications describe certain features of this new ink delivery system.

BRIEF SUMMARY OF THE INVENTION

This invention optimizes the performance of this new off-carriage, take-a-gulp ink delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replenishment. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

An inkjet printing system having a replaceable set of ink-related components which are installed together and replaced together as a single ink delivery system for each different color of ink. The set includes an ink printhead with an inlet port, an ink supply module, and a printhead service module, each of which is manually mountable by a user onto an inkjet printer. The ink supply module contains enough ink to completely replenish an entire printhead reservoir several times before the expected useful life of the printhead has expired, at which time a user can replace the entire set of ink-related components for a particular color. Similarly, the printhead service module is designed for reliable performance for the expected useful life of the printhead. This system enables the entire ink delivery system to be replaced for different printing needs, such as replacing indoor dye-based inks with outdoor pigment based inks.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
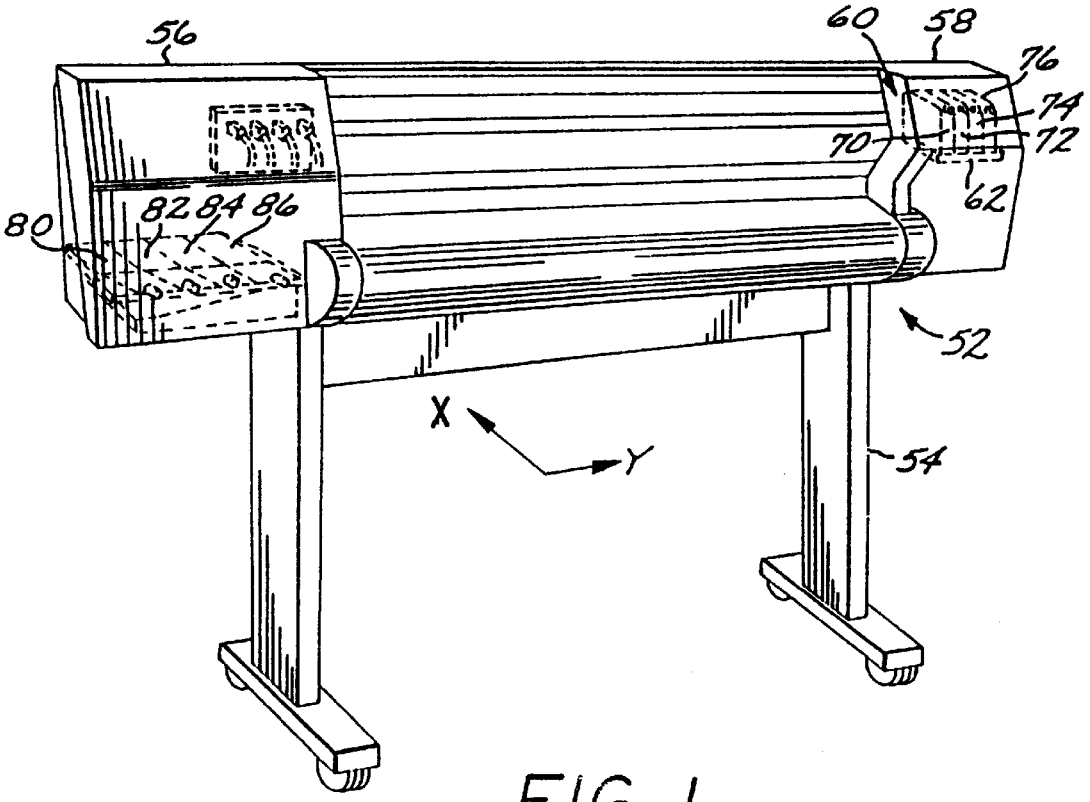
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 58. A print medium such as paper is positioned along a vertical or media axis by a media axis drive mechanism (not shown). As is common in the art, the media drive axis is denoted as the 'x' axis and the carriage scan axis is denoted as the 'y' axis.

Figure 3:
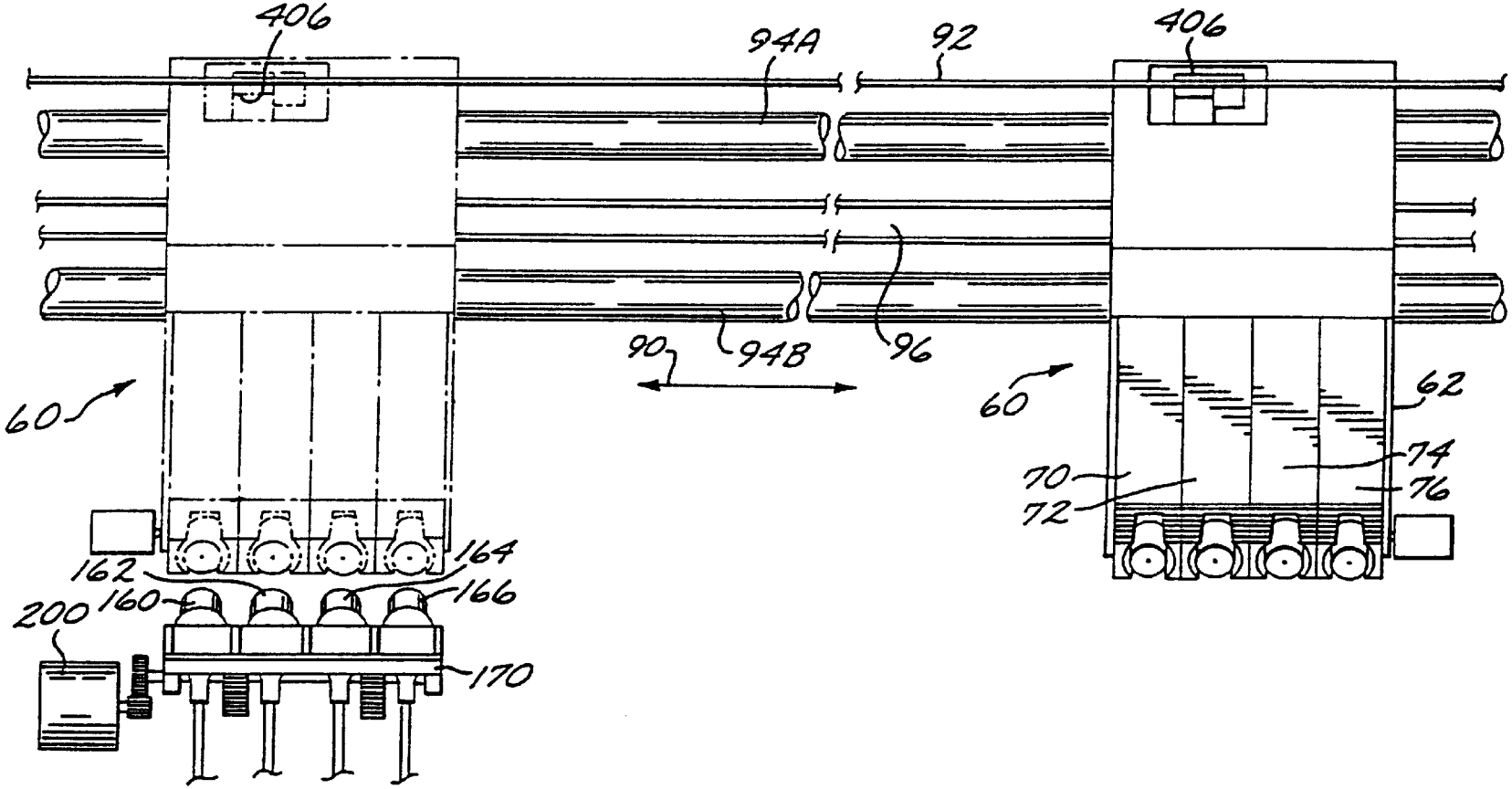
FIG. 3 is a top view showing the printer carriage and refill station.
Figure 4:
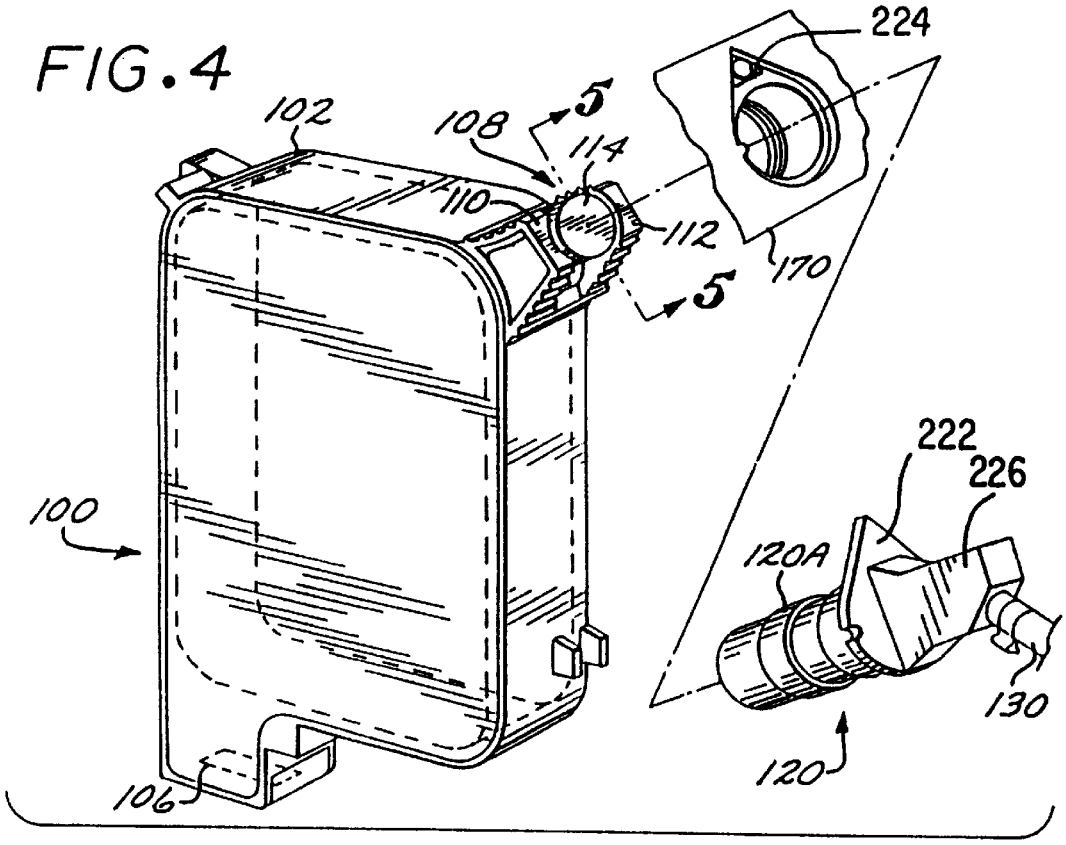
FIG. 4 is an isometric view of an ink-jet print cartridge usable in the system of FIG. 1, with a refill platform housing portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., black, yellow, magenta and cyan ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending application Ser. No. 08/805,860, filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
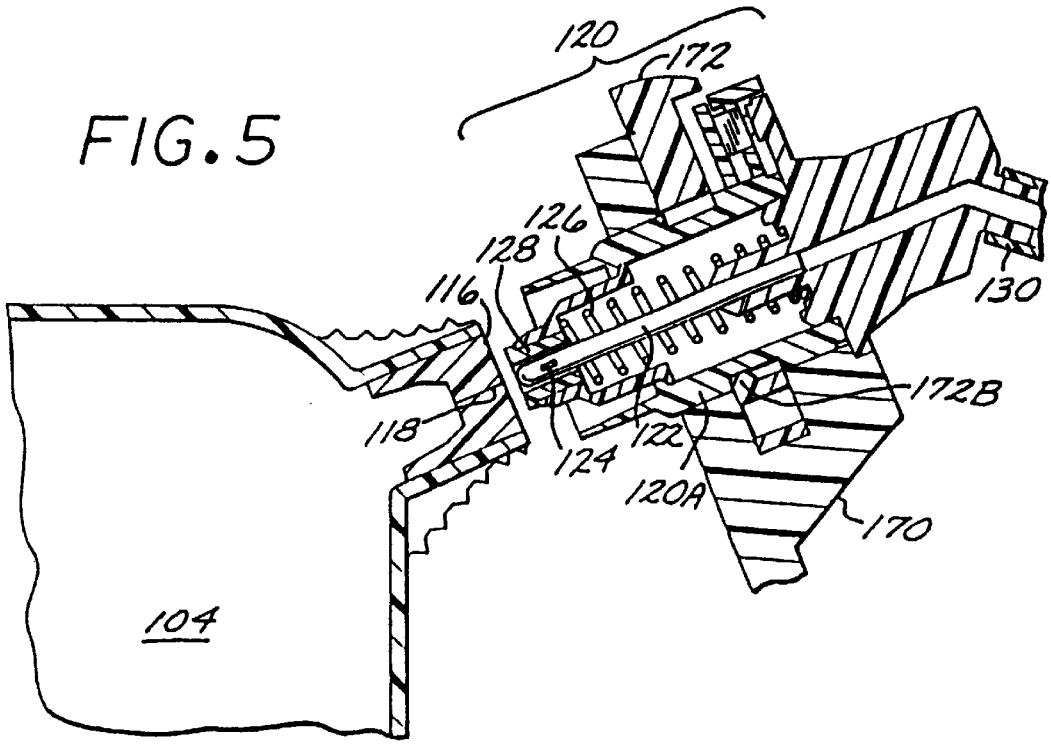
FIG. 5 is a cross-sectional view taken along line 5—5 of FIG. 4, showing the valve structure in a disengaged position relative to a refill port on the print cartridge.
Figure 9:
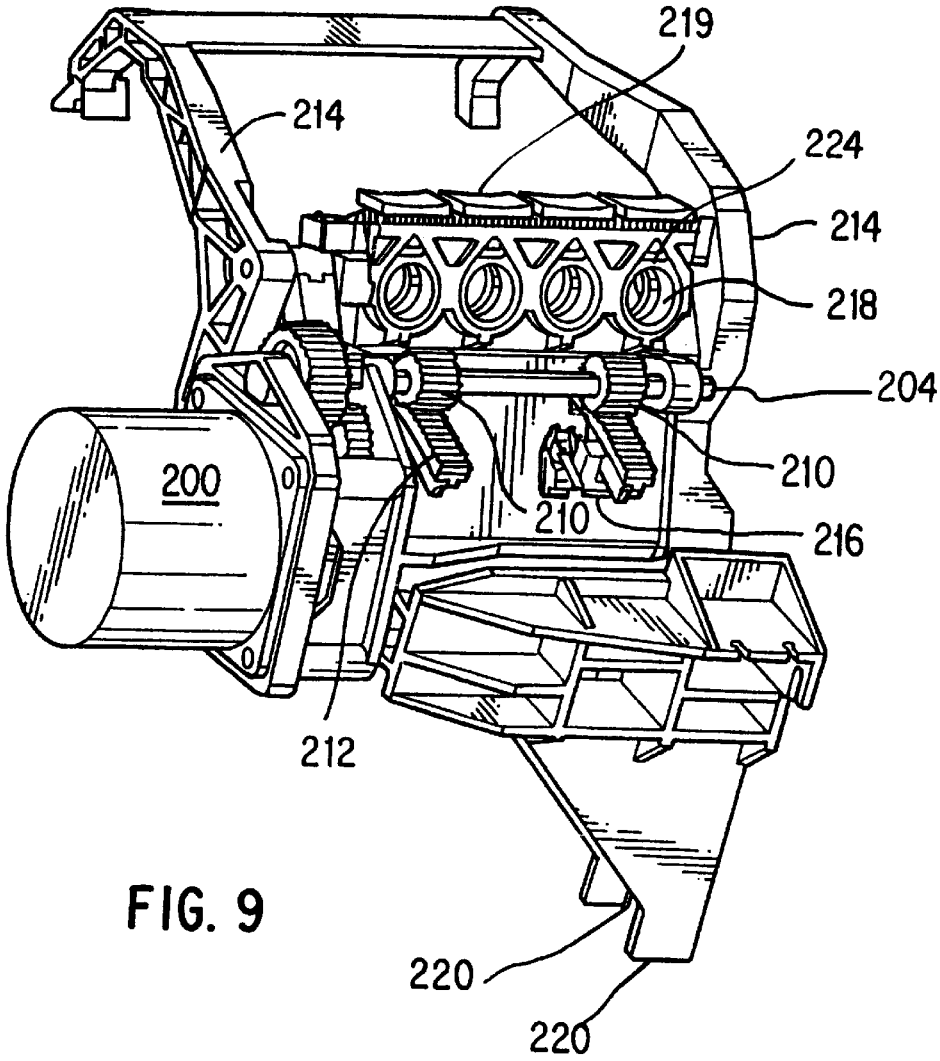
FIG. 9 is an enlarged view showing the mechanism for moving the valve structure, without any valves mounted thereon.

FIGS. 5–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 116. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 5. When the structure 120 is forced against the port 116, the collar is pressed up the length of the needle, allowing the needle tip to slid into the port opening 118, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 4–8 illustrate a locking structure 127 for releasably locking the valve 120 into the refill arm 170 at socket 174. The structure 172 has locking surfaces 172B (FIG. 5) which engage against the outer housing of the valve body 120A. The structure is biased into the lock position by integral spring member 172A (FIGS. 7 and 8). By exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
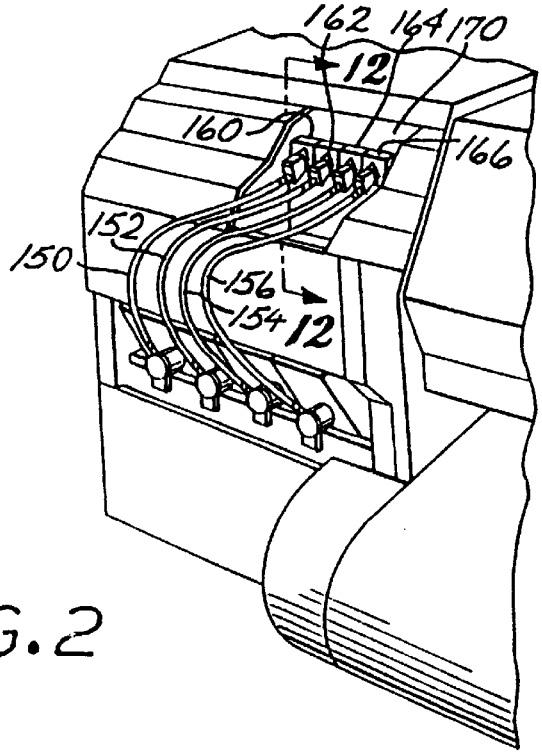
FIG. 2 is an enlarged view of a portion of the system of FIG. 1, showing the refill station.

In the exemplary system of FIG. 1, the refill platform 150 is in the left housing 56 of the printer 50 as shown in FIG. 2. The four off-carriage ink reservoirs 80–86 are supported on the platform 150. Short flexible tubes 150, 152, 154 and 156 connect between ports 80A–86A of corresponding reservoirs 80–86 and needle valve structure 160, 162, 164 and 166 supported at a refill station housing 170. These needle valve structures each correspond to the valve structure 120 of FIGS. 4–8.

The refill platform 150 is an elevator that holds the four reservoirs and can be moved up and down.

Figure 13:
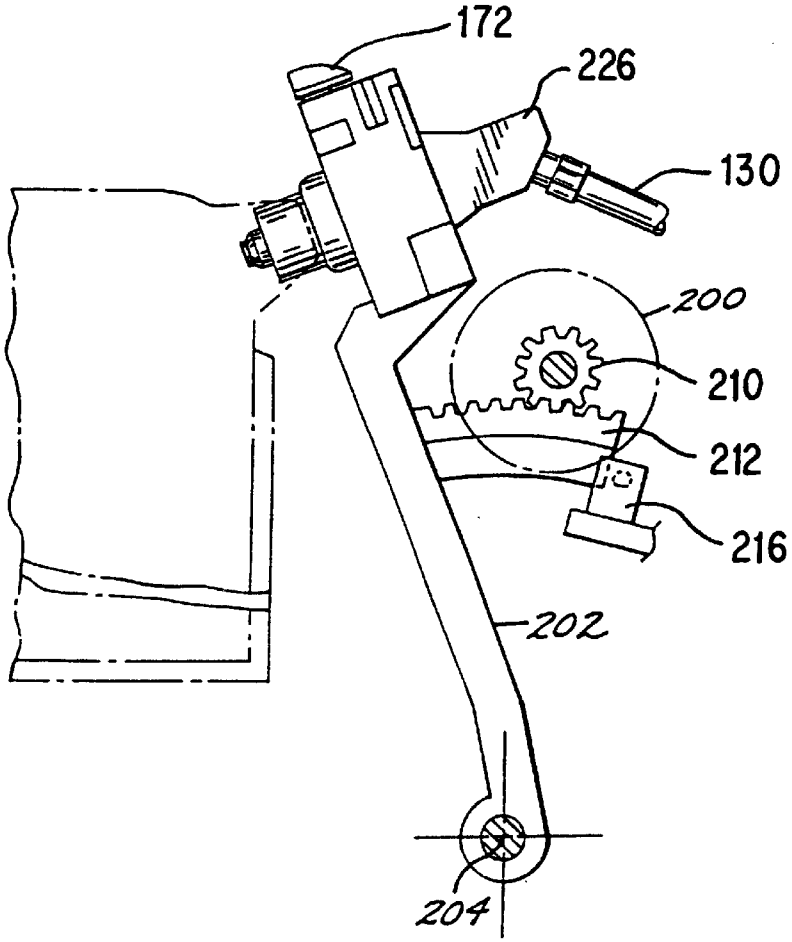
FIG. 13 is a detailed side view showing the mechanism for moving the valve structure in engaged position with a print cartridge.
Figure 12:
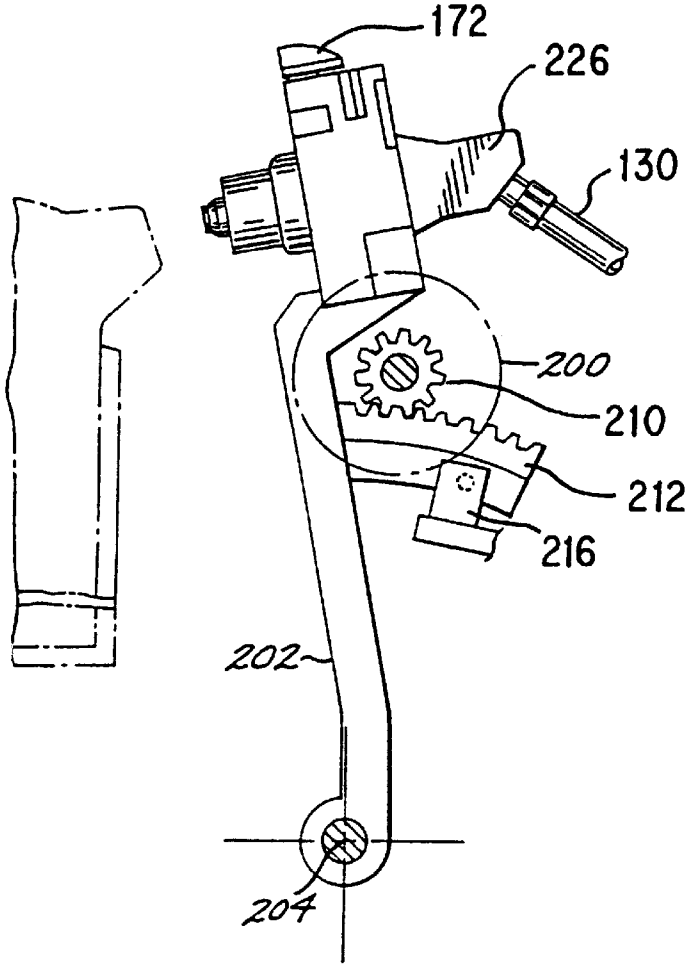
FIG. 12 is a detailed side view showing the mechanism for moving the valve structure in disengaged position with a print cartridge.

To perform a refill the carriage assembly 60 is moved to the refill station where the four off-carriage reservoirs 80–86 are connected to the corresponding print cartridges 70–76 via the shut-off valves 160–166. The connection of the reservoirs is accomplished by turning a stepper motor 200 that advances a lever 202 on which the valve structures and refill station housing 170 are mounted, as shown in FIGS. 3 and 12–13. A system suitable for moving the valves into and out of engagement with the refill ports is more fully described in co-pending application Ser. No. 08/805,861, filed Mar. 3, 1997, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self-regulating refill process where, as more ink is introduced into the print cartridge, the back pressure decreases to a point where the print cartridge can no longer pull additional ink from the cartridge and the refill stops. The pressure at which the flow of ink stops is governed by the distance offsetting the print cartridge and the off-carriage reservoir. The farther below the print cartridge the reservoir is located, the greater the final pressure in the print cartridge and the lower the resulting volume of ink in the print cartridge internal reservoir.

Figure 16:
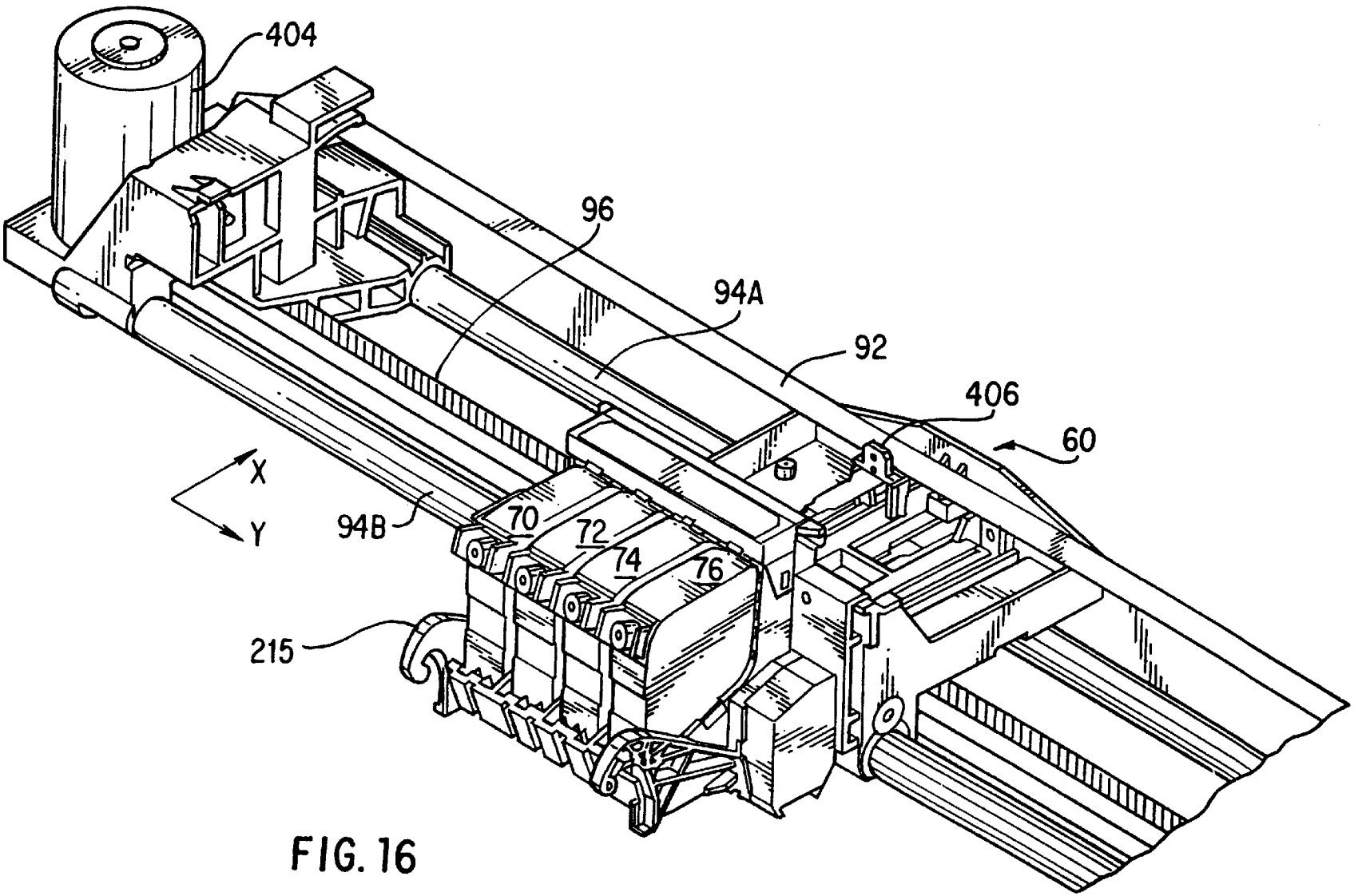
FIG. 16 is an isometric view of a carriage moving across a print zone.
Figure 17:
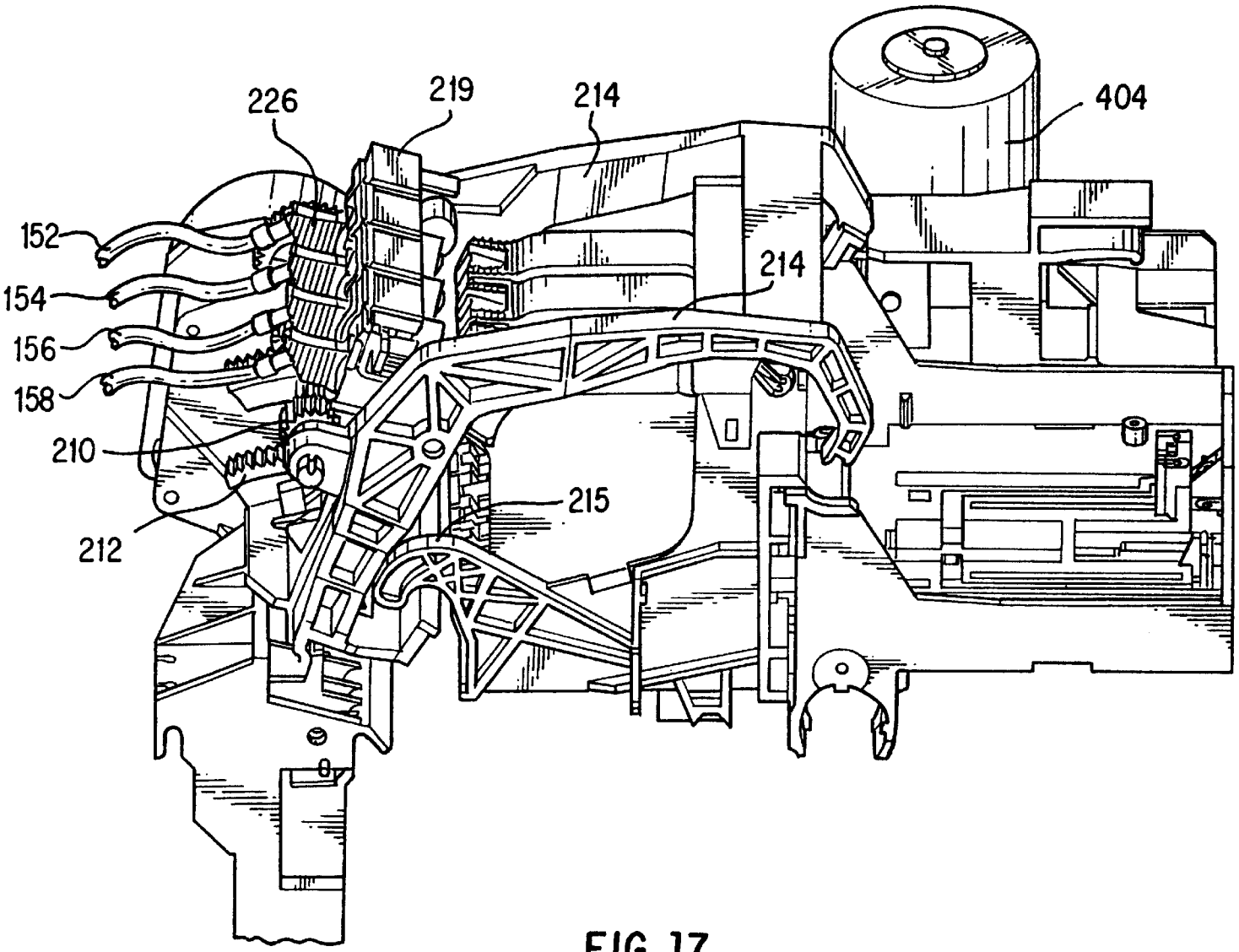
FIG. 17 shows the carriage of FIG. 16 in position at the refill station, with the valve structure in disengaged positon.

As best shown in FIG. 16, the present invention does not require the specifications of the carriage to be redesigned due to the drag and interference that results from typical off-carriage ink systems where ink supply tubes remain constantly connected with the cartridges on the carriage during a printing operation. In contrast, the carriage shown in the drawings can move back and forth across the print zone without any supply tube connection whatsoever. Moreover, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described. Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 mates with a matching orientation slot 224 by easy manual manipulation through a valve handle 226.

Figure 14A:
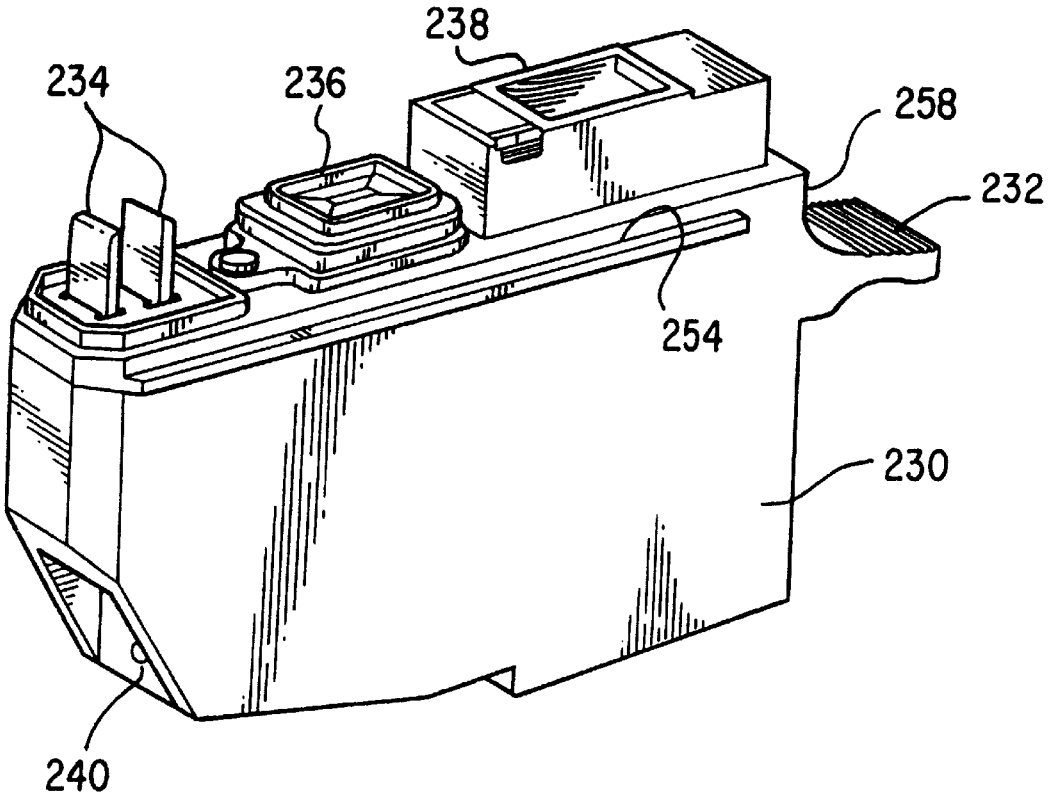
FIGS. 14A and 14B show an isometric and a side view, respectively of a service station module incorporating the present invention.
Figure 14B:
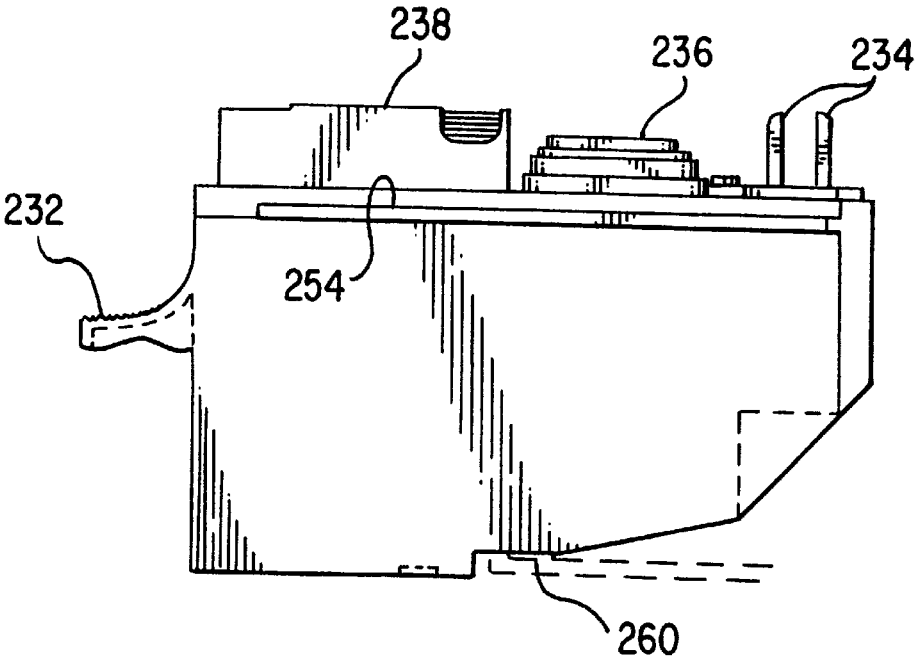
Figure 15:
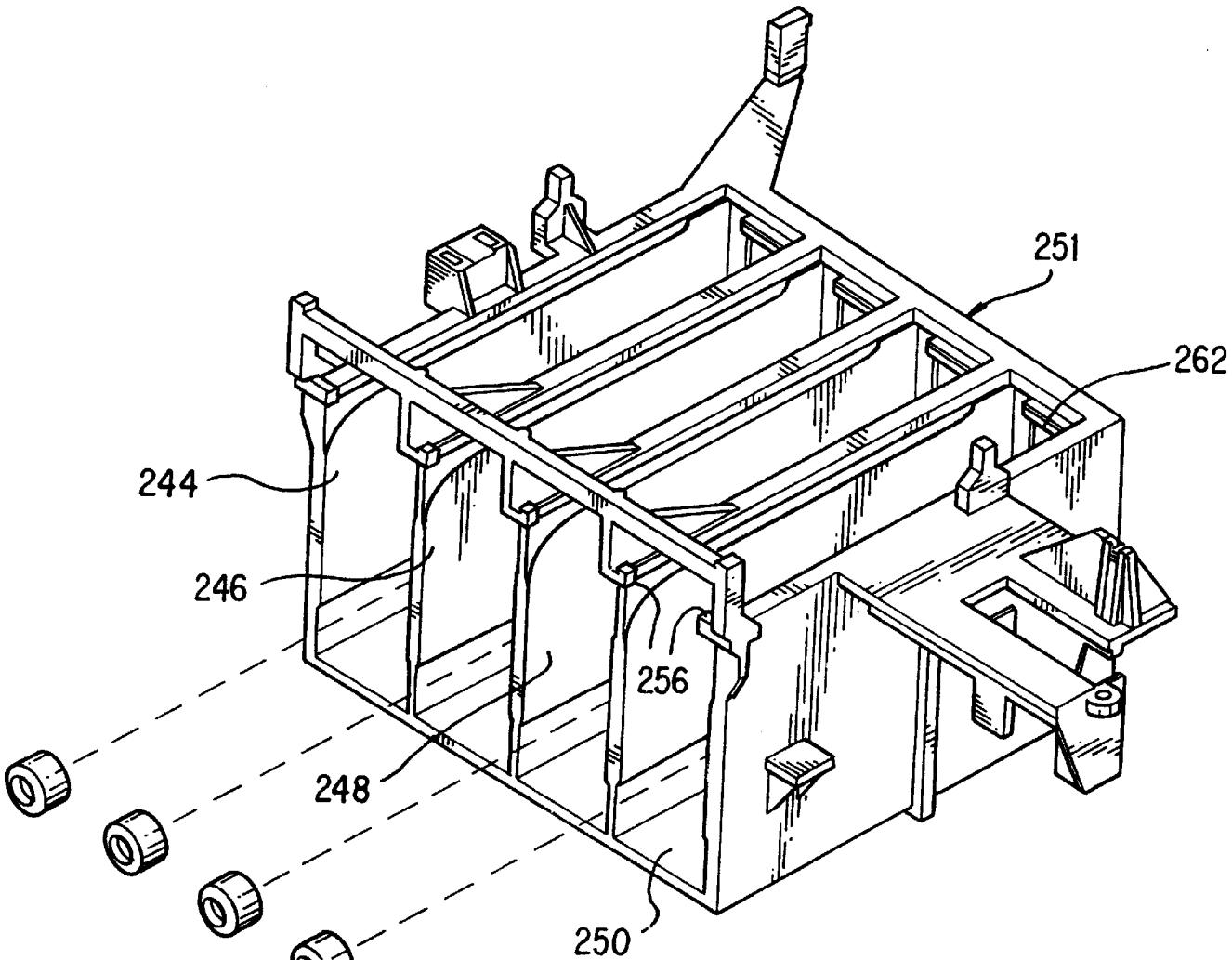
FIG. 15 is an isometric view of a carriage for removably mounting the service station module of FIGS. 14A–14B.

A unique narrow replaceable service station module 230 for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 248, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring arm 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
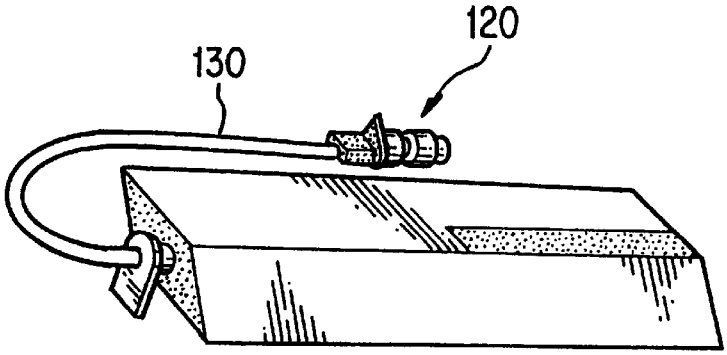
FIG. 10 shows an off-carriage ink supply module incorporating the present invention.
Figure 11:
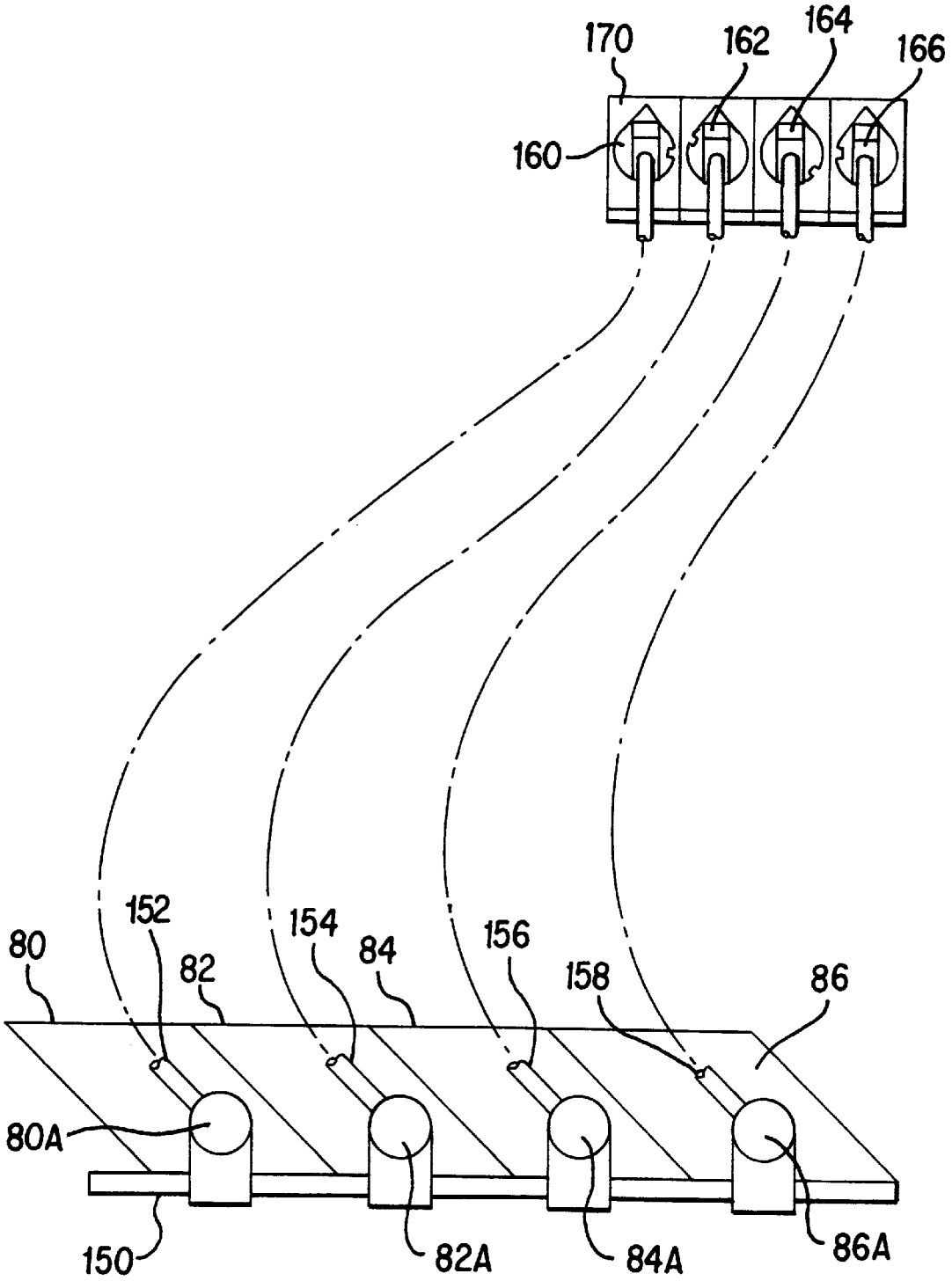
FIG. 11 is a schematic representation showing a plurality of off-carriage ink supply modules connected to the valve structure.

FIG. 10 shows the basic exterior structure of an ink supply module before installation, and FIG. 11 shows how four such modules are grouped together on a refill platform on the printer with their valves manually installed on the valve bracked.

Figure 18A:
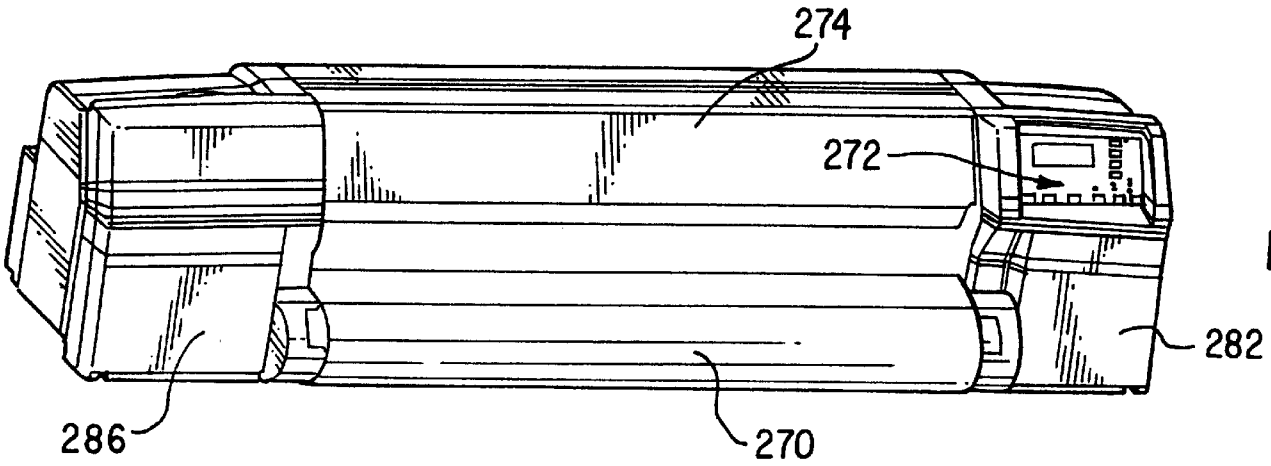
FIGS. 18A and 18B show the printer with the refill station and service station doors in closed and open positions, respectively.
Figure 18B:
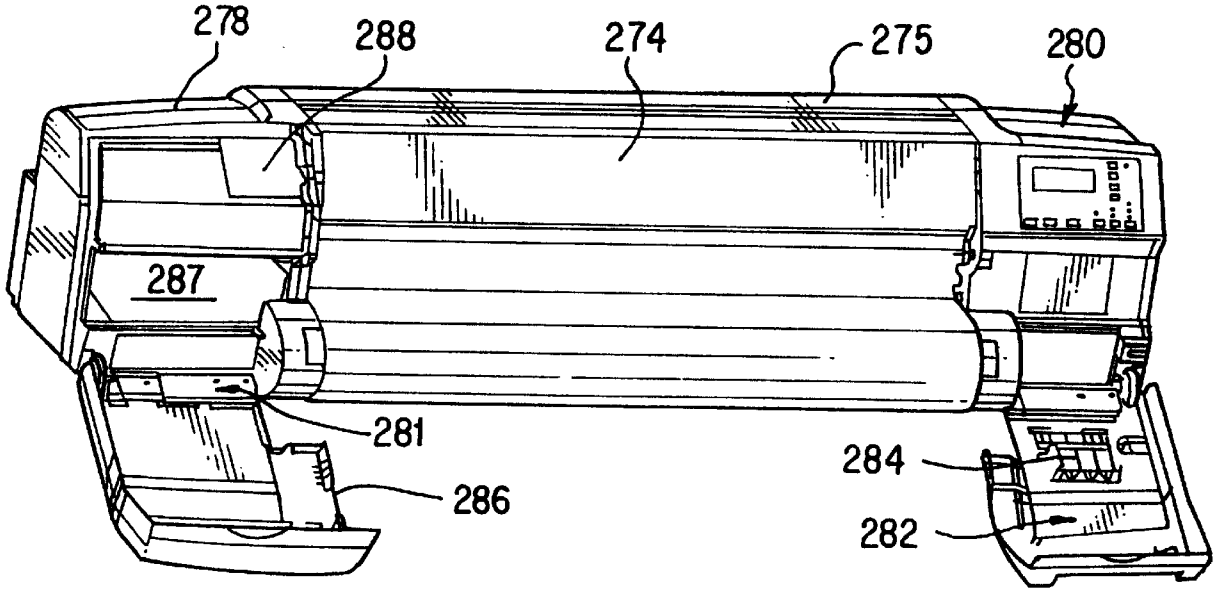
Figure 19:
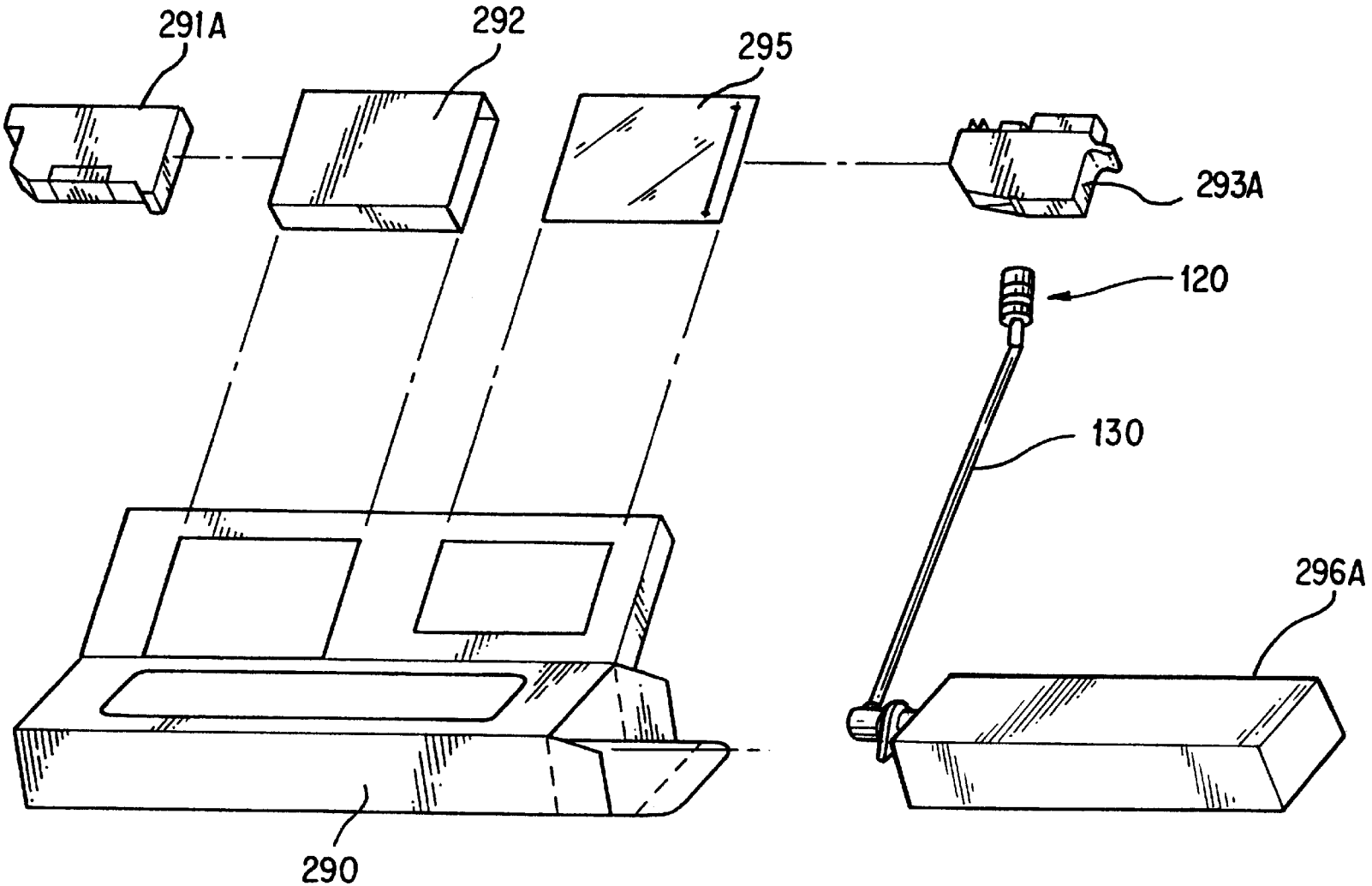
FIG. 19 is an exploded schematic view showing the integrated ink delivery system component of the invention (print cartridge, ink supply module and service station module) incorporated into a single package.
Figure 20:
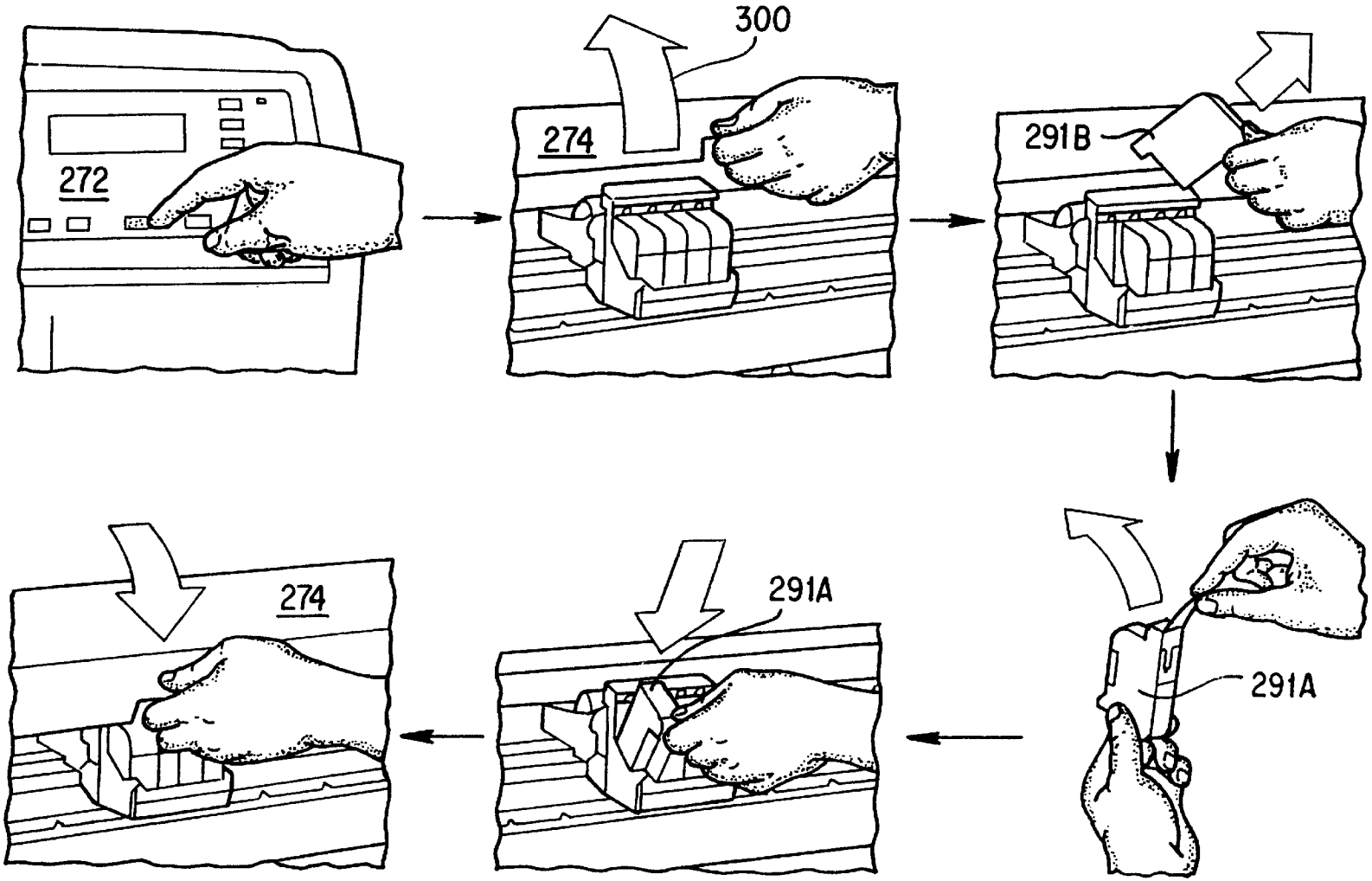
FIG. 20 shows six exemplary steps for replacing the print cartridge of the present invention.
Figure 21:
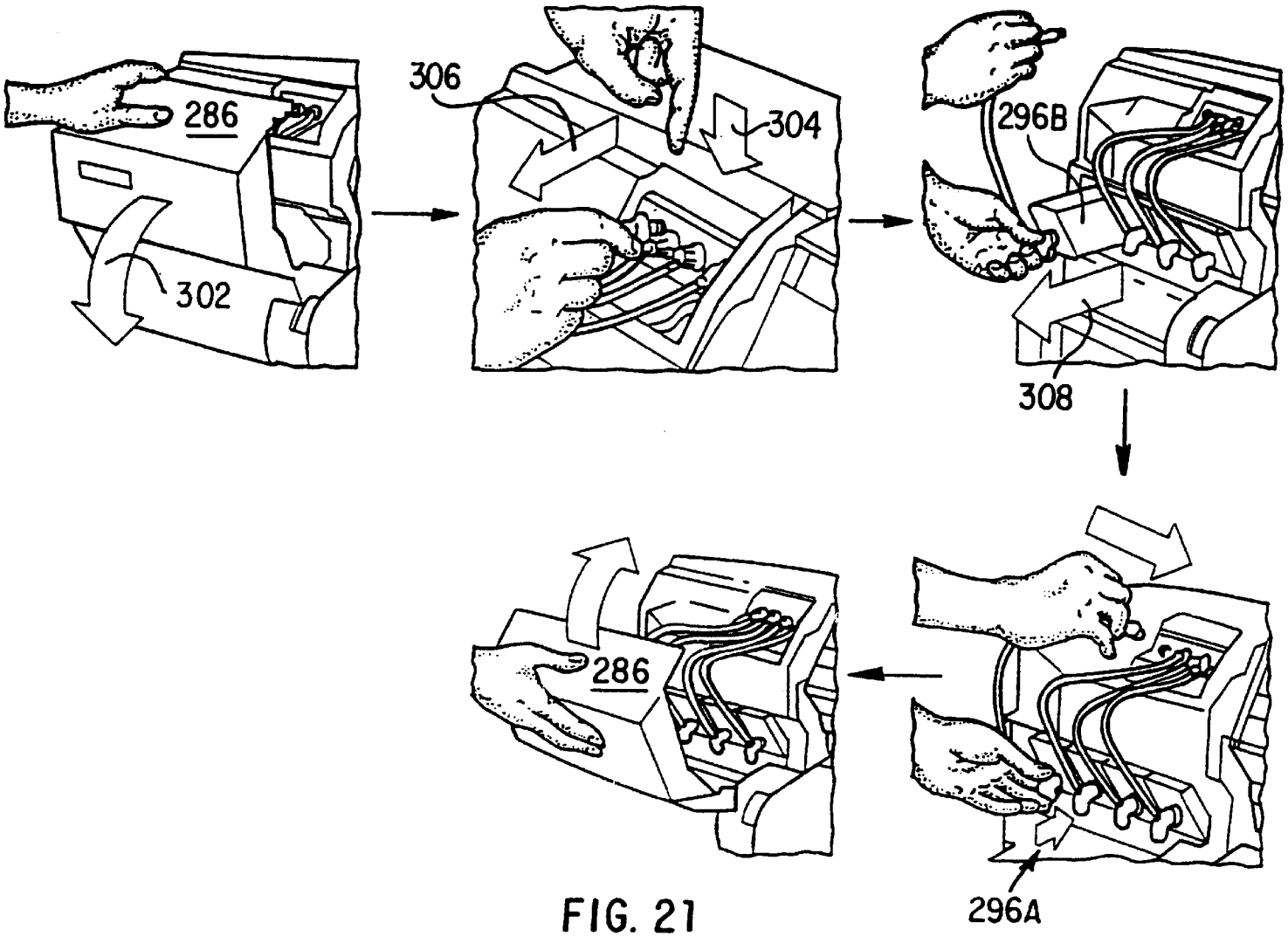
FIG. 21 shows five exemplary steps for replacing the ink supply module of the present invention.
Figure 22:
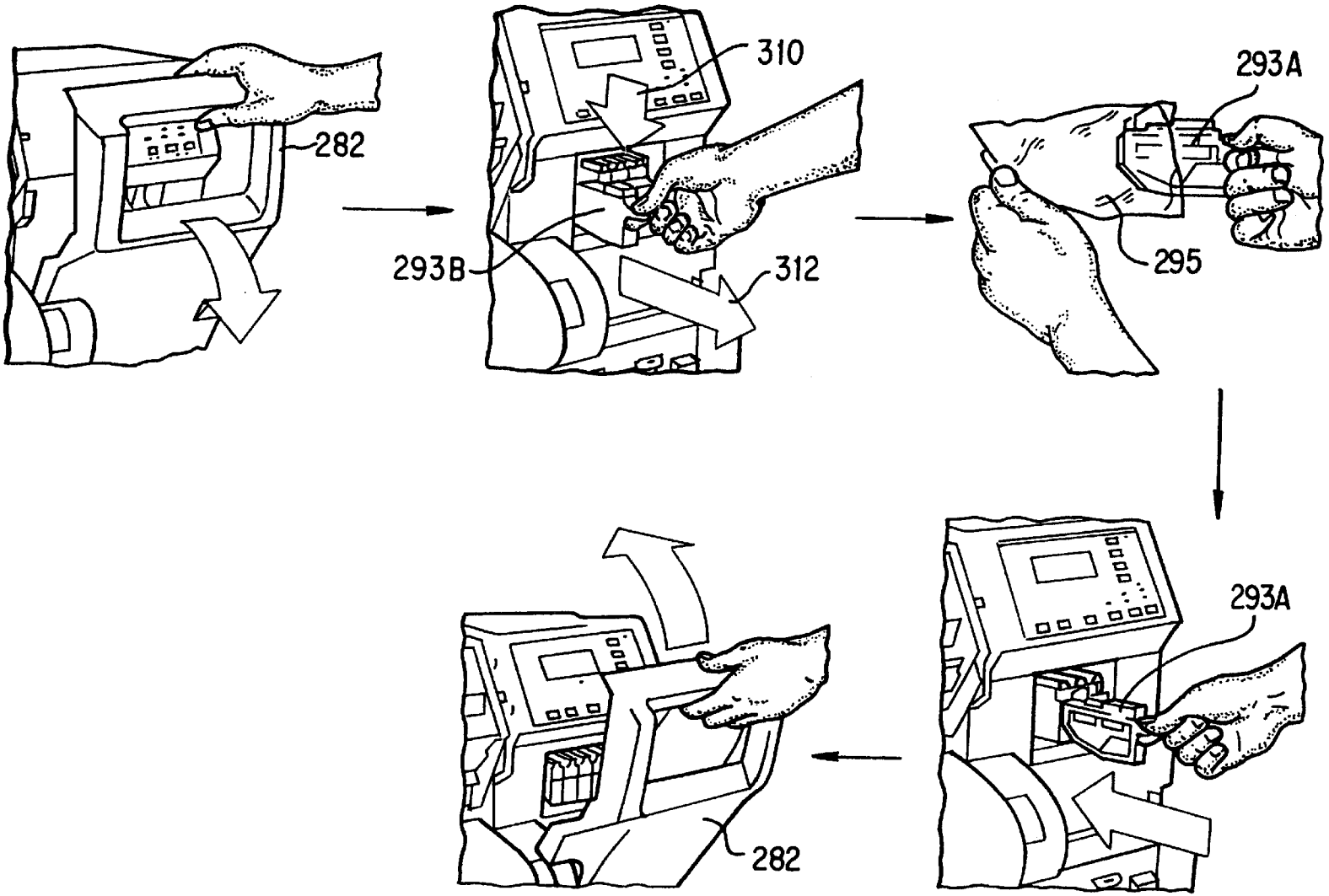
FIG. 22 shows five exemplary steps for replacing the service station module of the present invention.

FIGS. 18A and 18B illustrate the accessability required for replacement of the three basic components parts of the IDS. The front of the printer unit typically includes a roll feed unit 270, a control panel 272 and a print zone access door 274 adjacent an elongated frame member 275. The service station is located at the right end of the carriage scan axis, and a refill station 278 at the opposite end. Simple friction latches such as indicated at 280 are provided to assure proper closure of doors which a mounted on pivot hinges such as 281. A pusher plate 284 contacts and helps to position any incompletely mounted service station modules upon closure of a service station door 282. A similar door 286 closes off the refill station during normal operation of the printer. The refill station includes space 287 for an ink supply platform, and an access hole 288 from the platform to carriage-mounted printheads.

An installation procedure will now be described in conjunction with FIGS. 19–22. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG. 20, an old print cartridge 293B is easily removed and replaced with a new one. As shown in the self-explanatory sequence of drawings of FIG. 21, a depleted ink supply module 296B is removed without difficulty by first opening the ink door as shown by arrow 302, then pushing down on the lock button as shown by arrow 304 and at the same time pulling out the valve as shown by arrow 306. The depleted ink module 296B can then be replaced with a new ink supply module 296A. Finally as shown in the self-explanatory sequence of drawings of FIG. 22, after the access door is opened a user can push down on the handle in the direction shown by arrow 310 thereby dislodging an old service station module 293B, and then pull it out all the way as indicated by arrow 312, followed by installation of a new service station module 293A.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can be replaced for a particularly color of ink by a user, without the need of special tools and without the need of calling a specialized service person.

While a preferred embodiment of the invention has been shown and described, it will be appreciated by those skilled in the art that various modifications can be made without departing from the spirit and scope of the invention as defined by the following claims.

What is claimed is:

1. An inkjet printing system comprising:

a printer having a carriage and a carriage positioning mechanism for moving the carriage along a path which passes over a print zone;

at least one printhead cartridge removably mounted on said carriage and having an inlet port;

at least one ink container separate from said at least one printhead cartridge and removably mounted off said carriage for supplying ink to said printhead cartridge, said at least one ink container connected to an outlet control valve which is in a normally closed position to securely hold liquid ink in said ink container said at least one ink container which has an intermittent connection to said printhead cartridge through said outlet control valve;

a printhead service module removably mounted on said printer outside of the print zone in the traverse path of said carriage; and wherein said printhead cartridge, said at least one ink container, and said printhead service module constitute three separable components adapted for installation and replacement as a set to provide an integrated ink delivery system when said inlet port of said at least one printhead cartridge is connected to be in fluid communication with said outlet control valve of said at least one ink container.

2. The inkjet printing system of claim 1 wherein said outlet control valve is adapted for direct connection to said inlet port of said printhead cartridge to allow ink replenishment from said ink container to said printhead cartridge when said outlet control valve is in an open position.

3. The inkjet printing system of claim 1 wherein said outlet control valve is adapted for periodic engagement with said inlet port to provide ink replenishment to said printhead cartridge.

4. The inkjet printing system of claim 1 wherein each of said three separable components is adapted for separate installation on said printer.

5. The inkjet printing system of claim 1 wherein said printhead inlet port is in a normally closed position and is accessible for engagement when said printhead cartridge is mounted in said carriage.

6. The inkjet printing system of claim 5 wherein said printhead inlet port includes a self-sealing valve which maintains said printhead inlet port in its normally closed position.

7. The inkjet printing system of claim 1 which includes a given ink of predetermined characteristics which is located in an on-carriage reservoir associated with said printhead cartridge.

8. The inkjet printing system of claim 7 which includes said given ink also located in said at least one ink container.

9. The inkjet printing system of claim 1 which includes a given ink of predetermined characteristics which is located in said at least one ink container.

10. The inkjet printing system of claim 9 wherein a volume of said given ink in said at least one ink container is greater than a capacity of an on-carriage reservoir associated with said printhead cartridge.

11. The inkjet printing system of claim 10 wherein the volume of said given ink in said at least one ink container is more than twice the capacity of said on-carriage reservoir.

12. The inkjet printing system of claim 10 wherein the volume of said given ink in said at least one ink container is more than three times the capacity of said on-carriage reservoir.

13. The inkjet printing system of claim 10 wherein the volume of said given ink in said at least one ink container is more than eight times the capacity of said on-carriage reservoir.

14. The inkjet printing system of claim 1 which further includes:

a plurality of said printhead cartridges removably mounted on said carriage, each printhead having a different color ink;

a plurality of ink containers respectively associated with said plurality of printhead cartridges; and a plurality of printhead service modules respectively associated with said plurality of printhead cartridges.

15. The inkjet printing system of claim 14 wherein each of said plurality of said printhead cartridges is adapted for separate installation on said carriage.

16. The inkjet printing system of claim 14 wherein each of said plurality of ink containers is adapted for separate installation on said printer.

17. The inkjet printing system of claim 14 wherein each of said plurality of printhead service modules is adapted for separate installation on said printer.

18. A method of color inkjet printing using a plurality of printhead cartridges mounted on a moving carriage, each printhead cartridge having a different color ink, with a separate removable printhead service module mounted in a path of the moving carriage to perform ink-related service functions for each printhead, respectively, comprising the following steps:

providing an off-carriage ink container which has an intermittent connection to said off-carriage ink container through said outlet control valve, said outlet control valve connected to said off-carriage ink container;

filling the container with a given ink of predetermined characteristics;

transferring the ink of said filling step from the container to one of the printheads;

depositing some of the ink of said filling step on said printhead service module associated with said one of the printhead cartridges during the normal operation of the printer; and after a depletion of ink from the off-carriage ink container, replacing said off-carriage ink container, said one of said printhead cartridges and a corresponding service station module as a set of separable components with a fresh set comprising a printhead, off-carriage ink container and service station module.

19. The method of claim 18 wherein said filling step includes filling the off-carriage ink container with a volume of ink which is at least twice the capacity of an ink reservoir associated with the printhead cartridge on the carriage, and wherein said transferring step also occurs periodically after normal operation of the printer depletes some ink in the ink reservoir on the carriage.

20. A color inkjet printing system comprising:

a printer having a carriage and a carriage positioning mechanism for moving the carriage along a path which passes over a print zone;

a plurality of printhead cartridges each removably mounted on said carriage and each having an inlet port;

a plurality of ink containers respectively associated with but separable from said plurality of printhead cartridges with each ink container holding a different color of ink and removably mounted off said carriage for supplying ink to their respective printhead cartridges, each of said ink containers connected to an outlet control valve which is in a normally closed position, each of said ink containers which has an intermittent connection to the printhead cartridge through said outlet control valve;

a plurality of printhead service modules respectively associated with said plurality of printhead cartridges and with said plurality of ink containers and removably mounted on said printer outside of the print zone in the traverse path of said carriage; and wherein said associated printhead, ink container, and printhead service module constitute a group of three separately installable components adaptable for replacement as a set to provide an integrated ink delivery system for said different color of ink when said associated printhead is in fluid communication with its associated ink container.

21. The printing system of claim 20 which further includes an on-carriage reservoir connected to said inlet port for each of said printhead cartridges, and a quantity of said different color ink in said on-carriage reservoir.

* * * * *